US007428894B2

(12) United States Patent
Kikutani et al.

(10) Patent No.: US 7,428,894 B2
(45) Date of Patent: Sep. 30, 2008

(54) FUEL PRESSURE CONTROLLER

(75) Inventors: Takashi Kikutani, Ama-gun (JP); Hisashi Endo, Obu (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/783,005

(22) Filed: Apr. 5, 2007

(65) Prior Publication Data

US 2007/0251500 A1 Nov. 1, 2007

(30) Foreign Application Priority Data

Apr. 27, 2006 (JP) ..... 2006-122845

(51) Int. Cl.
*F02M 37/04* (2006.01)
*F02M 37/06* (2006.01)

(52) U.S. Cl. ..... 123/506; 123/458

(58) Field of Classification Search ..... 123/496, 123/495, 501, 506, 458, 446, 508, 456
See application file for complete search history.

(56) References Cited

U.S. PATENT DOCUMENTS 4,777,921 A * 10/1988 Miyaki et al. ..... 123/456
5,094,216 A * 3/1992 Miyaki et al. ..... 123/506
5,197,438 A * 3/1993 Kumano et al. ..... 123/506
5,201,294 A * 4/1993 Osuka ..... 123/458
5,277,156 A 1/1994 Osuka et al.
6,318,343 B1 * 11/2001 Nakagawa et al. ..... 123/500
6,694,952 B1 * 2/2004 Yamazaki et al. ..... 123/496
6,701,898 B2 * 3/2004 Tokuo et al. ..... 123/456
2003/0059322 A1 * 3/2003 Hiraku et al. ..... 417/505
2004/0055580 A1 * 3/2004 Yamada et al. ..... 123/495
2006/0118089 A1 * 6/2006 Tokuo et al. ..... 123/458

OTHER PUBLICATIONS

Notice of Invitation to Submit Opinion dated Feb. 29, 2008 issued in corresponding Korean Appln. No. 10-2007-0040631 with English translation.

* cited by examiner

*Primary Examiner*—Mahmoud Gimie
(74) *Attorney, Agent, or Firm*—Nixon & Vanderhye PC

(57) ABSTRACT

A fuel pump suctions fuel from a fuel tank and discharges the fuel. A discharge metering valve regulates an amount of the discharged fuel out of the suctioned fuel. The discharged amount is regulated by operating closing timing for closing the discharge metering valve through energization of the discharge metering valve. The fuel discharged by the fuel pump is pressure-fed to a common rail. A rotation angle interval between energizing operations of the discharge metering valve is lengthened when rotation speed of an output shaft of a diesel engine is high. Thus, a residual magnetic flux in the discharge metering valve is reduced. As a result, control of the fuel pressure can be suitably performed.

2 Claims, 8 Drawing Sheets

FUEL PRESSURE CONTROLLER

CROSS REFERENCE TO RELATED APPLICATION

This application is based on and incorporates herein by reference Japanese Patent Application No. 2006-122845 filed on Apr. 27, 2006.

BACKGROUND OF THE INVENTION

1. Field of the Invention

The present invention relates to a fuel pressure controller applied to a fuel supply system having a fuel pump that has an electromagnetic discharge metering valve for regulating a fuel amount discharged to an outside out of suctioned fuel and that is driven by a driving force of an internal combustion engine and a pressure accumulation chamber that accumulates the fuel pressure-fed by the fuel pump at a high-pressure state, the fuel pressure controller controlling fuel pressure in the pressure accumulation chamber by operating the discharge metering valve.

2. Description of Related Art

JP-A-H4-272471 describes a fuel supply system of this kind structured such that fuel is suctioned when a plunger of a fuel pump moves to a bottom dead center and such that a discharge metering valve is closed through electromagnetic drive to break communication between a fuel supply side and a plunger side when the plunger moves to a top dead center. This fuel supply system discharges the fuel remaining on the plunger side from the fuel pump to an outside when the metering valve is closed. JP-A-H4-272471 describes a fuel pressure controller that calculates a basic value of valve closing timing of the metering valve based on a target value of the fuel pressure in a pressure accumulation chamber (common rail) common to respective cylinders and a command value of an injection amount of an injector and that performs feedback correction of the basic value based on a difference between a sensed value of the fuel pressure and the target value of the fuel pressure. Thus, the fuel amount can be suitably regulated.

A force applied to the metering valve by the fuel increases if rotation speed increases. In such a case, there is a possibility that the metering valve closes (i.e., causes spontaneous closure) and the fuel is discharged from the fuel pump unintentionally although the closing operation of the metering valve is not performed. Therefore, the above-described fuel pressure controller operates the metering valve to a closed state constantly under such the situation. Thus, the fuel pressure controller stops the suctioning of the fuel when the plunger moves to the bottom dead center to prohibit the discharge of the fuel from the fuel pump.

Inventors of the present invention found that the minimum value of the rotation speed causing the spontaneous closure of the metering valve is lower than a value at which the force applied by the fuel is balanced out with a force of a member for opening the metering valve. This is attributed to the fact that the closing of the metering valve is facilitated by a residual magnetic flux remaining after the closing operation of the metering valve. Therefore, stoppage of the fuel pressure-feeding operation of the fuel pump is required at rotation speed lower than the maximum rotation speed, which is decided by mechanical properties and is not supposed to cause the closure of the metering valve.

A circuit for removing the residual magnetic flux of the metering valve may be provided. However, this can cause an increase in the size of a drive circuit driving the metering valve or an increase in the number of components.

SUMMARY OF THE INVENTION

It is an object of the present invention to provide a fuel pressure controller capable of suitably controlling fuel pressure by operating an electromagnetic discharge metering valve that regulates a fuel amount discharged to an outside out of suctioned fuel.

According to an aspect of the present invention, a fuel pressure controller has a reduction device that reduces the number of operations of a discharge metering valve to lengthen an interval between pressure-feeding operations with respect to the shortest cycle, in which a fuel pump can discharge fuel, when rotation speed of an internal combustion engine is equal to or higher than predetermined speed.

In this structure, the shortest cycle, in which the fuel pump can discharge the fuel, coincides with the operation cycle of the discharge metering valve during normal processing. The time interval between the operations of the discharge metering valve shortens as the rotation speed increases. Therefore, there is a possibility that the residual magnetic flux does not reduce sufficiently during the time interval. Moreover, the force applied to the discharge metering valve by the fuel increases and the spontaneous closure of the discharge metering valve is induced more as the rotation speed increases. The above-described structure reduces the number of the operations of the discharge metering valve to lengthen the interval between the pressure-feeding operations when the rotation speed is equal to or higher than the predetermined speed. Accordingly, the residual magnetic flux of the discharge metering valve can be suitably reduced. As a result, the rotation speed causing the spontaneous closure of the discharge metering valve can be increased, so the control of the fuel pressure can be suitably performed.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF EXAMPLE EMBODIMENTS

Figure 1:
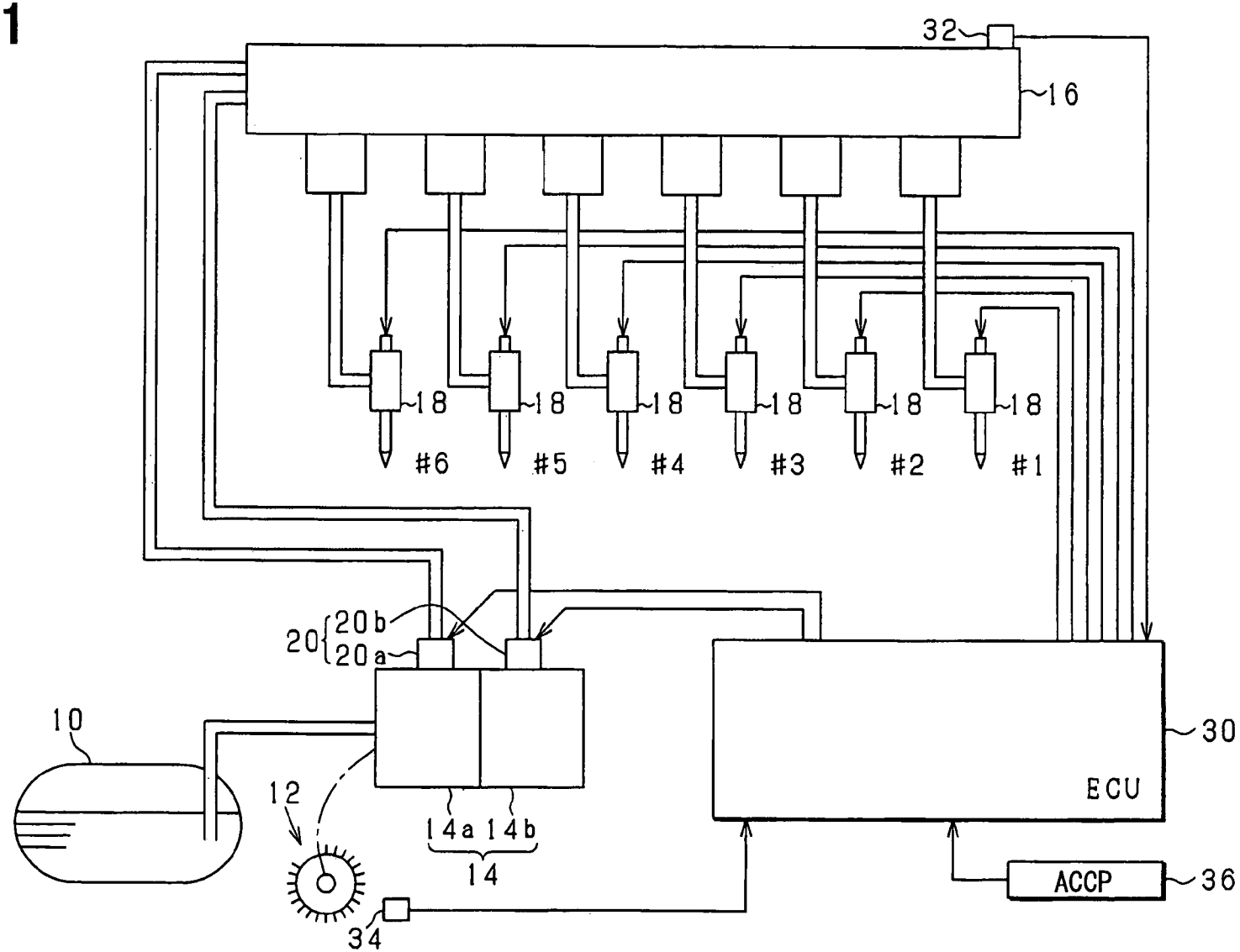
FIG. 1 is a diagram showing an engine system according to a first embodiment of the present invention.

Referring to FIG. 1, an engine system according to a first embodiment of the present invention is illustrated. An engine-driven fuel pump 14 draws fuel stored in a fuel tank 10. The fuel pump 14 is applied with a force by an output shaft 12 of a diesel engine. The fuel pump 14 includes a pair of fuel pumps 14*a*, 14*b* and a discharge metering valve 20 consisting of a pair of normally-open discharge metering valves 20*a*, 20*b*. The discharge metering valve 20 regulates a discharged fuel amount out of the fuel drawn from the fuel tank 10. The fuel discharged from the fuel pump 14 is pressure-fed to a common rail 16, which supplies the fuel to injectors 18 of respective cylinders (six cylinders in the present embodiment).

An electronic control unit 30 (ECU) receives sensing values of various sensors sensing operation states of the engine such as a fuel pressure sensor 32 sensing the fuel pressure in the common rail 16 and a rotation angle sensor 34 sensing a rotation angle of the output shaft 12 and a sensing value of an accelerator sensor 36 sensing an operation amount ACCP of an accelerator pedal. The ECU 30 performs output control of the engine by operating actuators of the engine such as the discharge metering valve 20 and the injectors 18 based on the sensing values of the sensors. At that time, the ECU 30 controls the fuel pressure in the common rail 16 to a target value of the fuel pressure (target fuel pressure) to suitably perform the output control of the engine.

Figure 2:
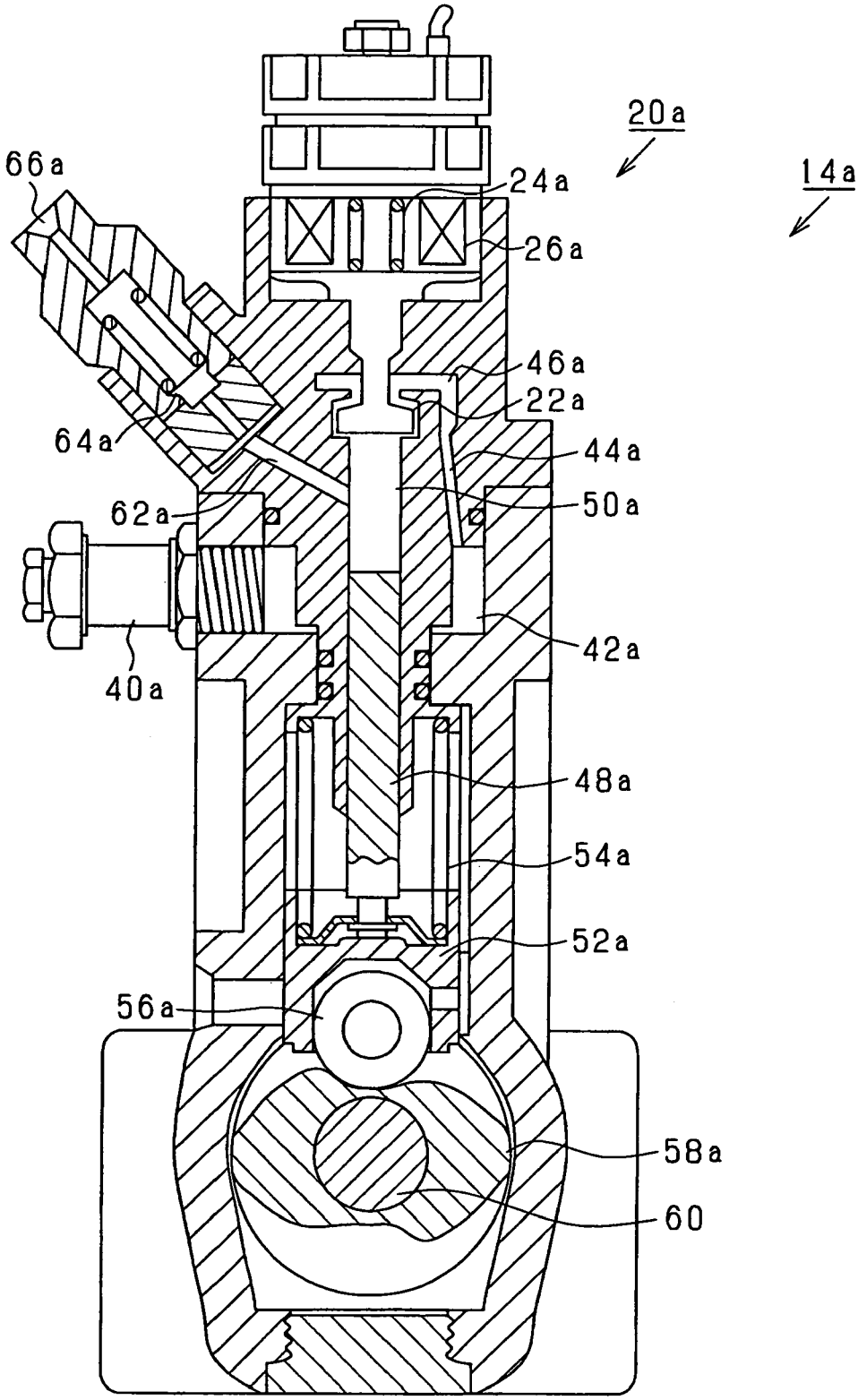
FIG. 2 is a sectional view showing a fuel pump according to the first embodiment.

FIG. 2 shows a structure of the fuel pump 14. Though FIG. 2 shows only a part of the fuel pump 14 (fuel pump 14a) corresponding to the discharge metering valve 20*a*, the fuel pump 14 also has the same members corresponding to the discharge metering valve 20*b* as the members shown in FIG. 2. As shown in FIG. 2, the fuel pump 14*a* is formed with a fuel introduction passage 40*a* connected with the fuel tank 10. The fuel introduction passage 40*a* communicates with a low-pressure chamber 42*a*. The low-pressure chamber 42*a* can communicate with a pressurization chamber 50*a* through a supply passage 44*a* and a gallery 46*a*. The pressurization chamber 50*a* is defined by an inner wall of the fuel pump 14*a* and a plunger 48*a*.

An end of the plunger 48*a* opposite from the pressurization chamber 50*a* is linked with a valve seat 52*a*. The valve seat 52*a* is pushed by a plunger spring 54*a* in a direction opposite to the pressurization chamber 50*a*, i.e., toward a cam roller 56*a*. The cam roller 56*a* is located to contact a cam 58*a*. The cam 58*a* is linked with a camshaft 60, which is linked with the output shaft 12 and which rotates once while the output shaft 12 rotates twice. If the camshaft 60 rotates in accordance with the rotation of the output shaft 12, the plunger 48*a* reciprocates between a top dead center and a bottom dead center. Thus, the pressurization chamber 50*a* is expanded and contracted. The pressurization chamber 50*a* can communicate with a discharge hole 66*a* through a discharge passage 62*a* and a check valve 64*a*.

Communication between the pressurization chamber 50*a* and the gallery 46*a* is provided and broken by a valve member 22*a* of the discharge metering valve 20*a*. The discharge metering valve 20*a* has a valve spring 24*a* and an electromagnetic solenoid 26*a*. The valve spring 24*a* biases the valve member 22*a* toward the pressurization chamber 50*a*, i.e., in a valve opening direction. The electromagnetic solenoid 26*a* attracts the valve member 22*a* in a direction opposite to a restoring force of the valve spring 24*a*, i.e., in a valve closing direction. FIG. 2 shows a state in which a magnetic flux of the electromagnetic solenoid 26*a* is zero and the valve member 22*a* is in a valve-opened state due to the force of the valve spring 24*a*.

With this structure, the fuel in the low-pressure chamber 42*a* is suctioned into the pressurization chamber 50*a* through the supply passage 44*a* and the gallery 46*a* when the plunger 48*a* moves from the top dead center to the bottom dead center in accordance with the rotation of the output shaft 12 and the volume of the pressurization chamber 50*a* increases. The fuel in the pressurization chamber 50*a* is pressurized if the communication between the pressurization chamber 50*a* and the low-pressure chamber 42*a* is broken by closing the valve member 22*a* when the plunger 48*a* moves from the bottom dead center to the top dead center and the volume of the pressurization chamber 50*a* reduces. If the force caused by the fuel pressure in the pressurization chamber 50*a* exceeds the force for bringing the check valve 64*a* to a valve-closed state, the check valve 64*a* opens and the fuel in the pressurization chamber 50*a* is discharged from the discharge hole 66*a* to an outside.

Figure 3:
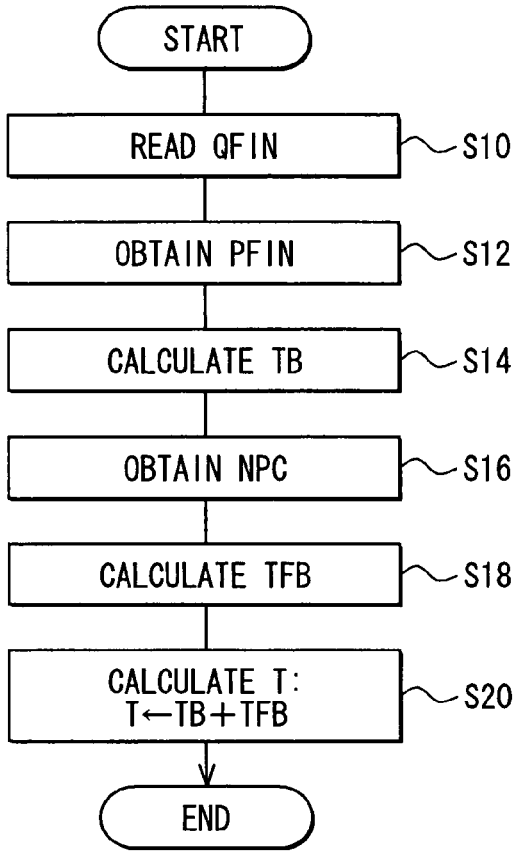
FIG. 3 is a flowchart showing processing steps of fuel pressure control according to the first embodiment.

FIG. 3 shows processing steps regarding the control of the fuel pressure in the common rail 16 performed by the ECU 30. The ECU 30 repeatedly performs the processing shown in FIG. 3, for example, in a predetermined cycle. In a series of the processing, first, Step S10 reads a command value of an injection amount of the injector 18 (command injection amount QFIN). The command injection amount QFIN is calculated based on the operation amount ACCP of the accelerator pedal and the rotation speed NE of the output shaft 12 by separate logic (not shown). Following Step S12 obtains the target fuel pressure PFIN of the common rail 16. The target fuel pressure PFIN is calculated based on the rotation speed NE of the output shaft 12 and the command injection amount QFIN by separate logic (not shown).

Following Step S14 calculates a basic value TB of valve closing timing of the discharge metering valve 20 based on the target fuel pressure PFIN and the command injection amount QFIN. The basic value TB of the valve closing timing is advanced more as the command injection amount QFIN increases. This corresponds to that the required discharge amount of the fuel pump 14 increases as the command injection amount QFIN increases. The basic value TB is advanced more as the fuel pressure increases. It is because, for example, an amount of the fuel that leaks from the common rail 16 into the fuel tank 10 through the injector 18 without being injected by the injector 18 increases as the fuel pressure increases. No leak passage is shown in FIG. 1 for the sake of simplicity. Step S14 may calculate the basic value TB by using a map deciding a relationship among the target fuel pressure PFIN, the command injection amount QFIN and the basic value TB.

Following Step S16 reads the sensing value NPC of the fuel pressure sensor 32. Step S18 calculates a feedback correction value TFB based on the sensed value NPC of the fuel pressure and the target fuel pressure PFIN. For example, the feedback correction value TFB may be calculated in accordance with a proportional term, a differential term and an integral term based on a difference between the sensed value NPC of the fuel pressure and the target fuel pressure PFIN. Following Step S20 calculates final valve closing timing T by adding the feedback correction value TFB to the basic value TB of the valve closing timing. The desired fuel can be discharged from the fuel pump 14 by performing the valve closing operation of the discharge metering valve 20 at the valve closing timing T.

Figure 4:
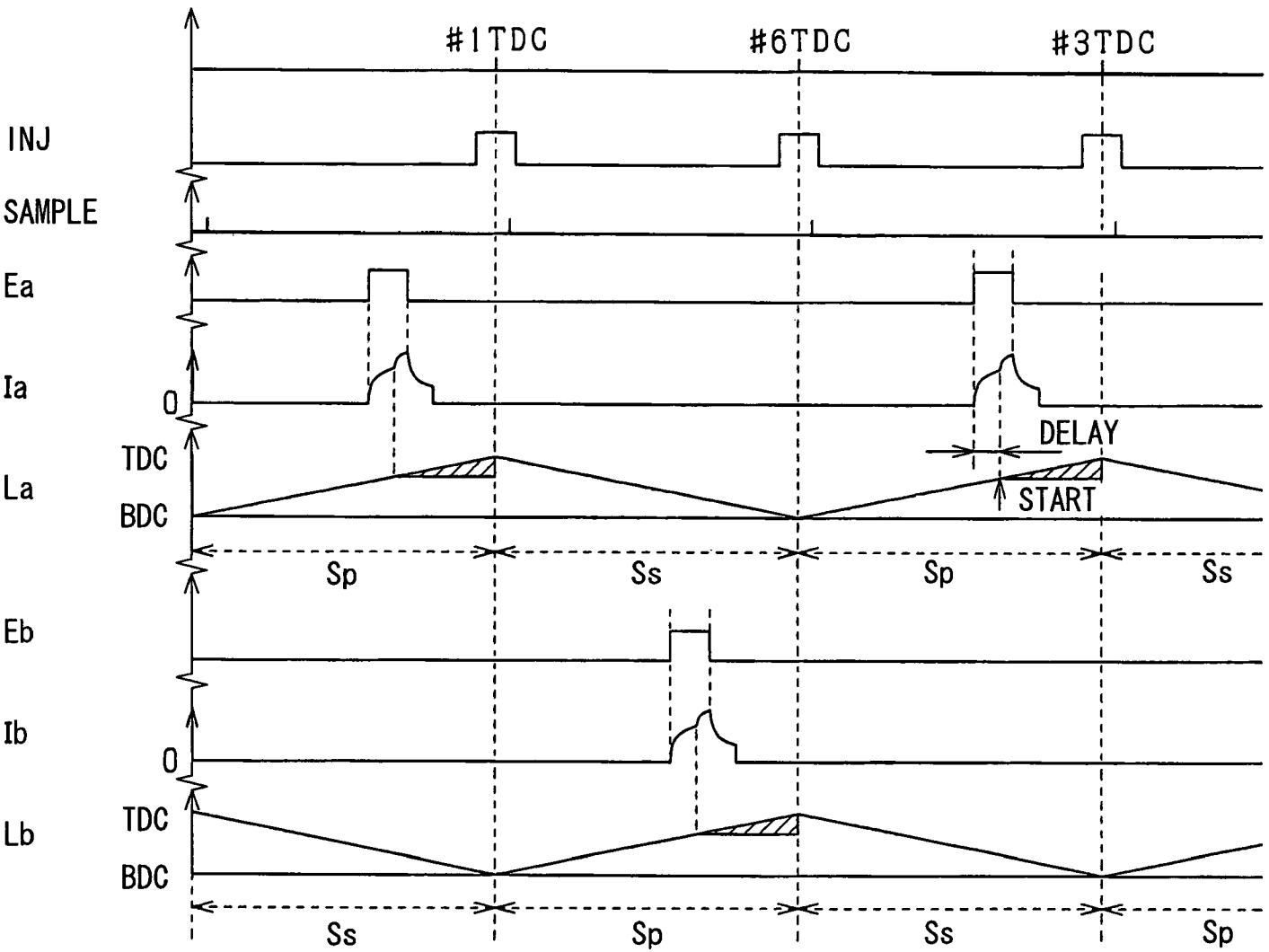
FIG. 4 is a time chart showing a mode of the fuel pressure control according to the first embodiment.

FIG. 4 shows a mode of the above-described fuel pressure control. In FIG. 4, INJ represents injection timing of the injector 18, SAMPLE is sampling timing of the sensed value NPC of the fuel pressure used in the processing shown in FIG.

3, Ea is an energization command period of the discharge metering valve 20*a*, Ia is drive current of the discharge metering valve 20*a*, and La is a transition of a lift amount of the plunger 48*a*. Eb represents an energization command period of the discharge metering valve 20*b*, Ib is a drive current of the discharge metering valve 20*b* and Lb is a transition of a lift amount of the plunger 48*b*. #1TDC, #3TDC and #6TDC represent top dead centers of the first, third and sixth cylinders respectively. Ss represents a suction stroke of each one of the fuel pumps 14*a*, 14*b*, and Sp is a pressure-feeding stroke of each one of the fuel pumps 14*a*, 14*b*. TDC and BDC respectively represent the top dead center and the bottom dead center of each one of the plungers 48*a*, 48*b*. Each of shaded areas in FIG. 4 shows a discharge stroke of each one of the fuel pumps 14*a*, 14*b*.

As shown in FIG. 4, the system according to the present embodiment is a synchronous system that relates the top dead center of each one of the plungers 48*a*, 48*b* to the top dead center of each cylinder of the engine on one-to-one basis and that relates the fuel injection to the fuel pressure-feeding on one-to-one basis. The fuel is suctioned into the pressurization chamber 50*a* (50*b*) if the plunger 48*a* (48*b*) moves from the top dead center to the bottom dead center (during suction stroke Ss). The fuel is discharged from the fuel pump 14 by closing the discharge metering valve 20*a* (20*b*) when the plunger 48*a* (48*b*) moves from the bottom dead center to the top dead center (during pressure-feeding stroke Sp).

If the drive current is caused to flow through the electromagnetic solenoid 26*a* (26*b*) of the discharge metering valve 20*a* (20*b*), there occurs a point (pressure-feeding start point: START shown in FIG. 4), at which the increase amount of the current rapidly enlarges and the discharge metering valve 20*a* (20*b*) closes. Accordingly, a certain delay (DELAY shown in FIG. 4) is caused between the energization command start applied to the discharge metering valve 20*a* (20*b*) and the pressure-feeding start point. Therefore, adjustment for compensating for the delay should be preferably applied to the processing of calculating the basic value TB in the processing shown in FIG. 3.

The end of the energization of the electromagnetic solenoid 26*a* (26*b*) is advanced from the timing at which the plunger 48*a* (48*b*) reaches the top dead center. It is because the fuel applies a force to the valve member 22*a* (22*b*) to close during the pressure-feeding stroke and the discharge metering valve 20*a* (20*b*) maintains the closed state during the pressure-feeding stroke once the discharge metering valve 20*a* (20*b*) closes.

The fuel pressure in the common rail 16 can be controlled by pressure-feeding the fuel from the fuel pump 14 to the common rail 16 in the manner described above.

When the plunger 48*a* (48*b*) moves from the bottom dead center to the top dead center, the fuel in the pressurization chamber 50*a* (50*b*) flows out to the low-pressure chamber 42*a* (42*b*) before the valve member 22*a* (22*b*) of the discharge metering valve 20*a* (20*b*) closes. At that time, a restrictor effect between the pressurization chamber 50*a* (50*b*) and the gallery 46*a* (46*b*) causes a differential pressure between the pressurization chamber 50*a* (50*b*) and the gallery 46*a* (46*b*). The differential pressure applies a force to the valve member 22*a* (22*b*) in a direction of the movement of the plunger 48*a* (48*b*). The force tends to increase as the reciprocation speed of the plunger 48*a* (48*b*) increases. That is, the force increases as the rotation speed of the output shaft 12 increases.

If the force exceeds the restoring force of the valve spring 24*a* (24*b*) pushing the valve member 22*a* (22*b*) in the valve opening direction, the valve member 22*a* (22*b*) spontaneously change to the closed state (i.e., causes spontaneous closure) although the energization operation of the electromagnetic solenoid 26*a* (26*b*) is not performed. If the spontaneous closure of the valve member 22*a* (22*b*) occurs, the fuel amount discharged from the fuel pump 14 exceeds an intended amount. As a result, there is a possibility that the fuel pressure in the common rail 16 excessively increases over the target fuel pressure PFIN.

The spontaneous closure of the valve member 22*a* (22*b*) occurs when the resultant force generated by the fuel in the pressurization chamber 50*a* (50*b*) and the residual magnetic flux in the magnetic solenoid 26*a* (26*b*) exceeds the force of the valve spring 24*a* (24*b*). Normally, the time interval between the operations of the discharge metering valve 20*a* (20*b*) shortens as the rotation speed increases. Accordingly, the residual magnetic flux that is caused by the previous operation of the discharge metering valve 20*a* (20*b*) and that remains even at the present operation of the discharge metering valve 20*a* (20*b*) increases as the rotation speed increases.

Therefore, it is certainly expected that the rotation speed causing the spontaneous closure can be increased by reducing the residual magnetic flux in the electromagnetic solenoid 26*a* (26*b*) remaining before the start of the energization in the pressure-feeding stroke. The residual magnetic flux attenuates with time. Therefore, the system according to the present embodiment performs reduction processing (thinning processing) for reducing the number of the operations of the discharge metering valves 20*a*, 20*b* to lengthen the interval between the pressure-feeding operations with respect to the shortest cycle, in which the fuel pump 14 can discharge the fuel, when the rotation speed of the output shaft 12 is equal to or higher than predetermined speed. Thus, increase of the rotation speed causing the spontaneous closure is aimed.

Figure 5:
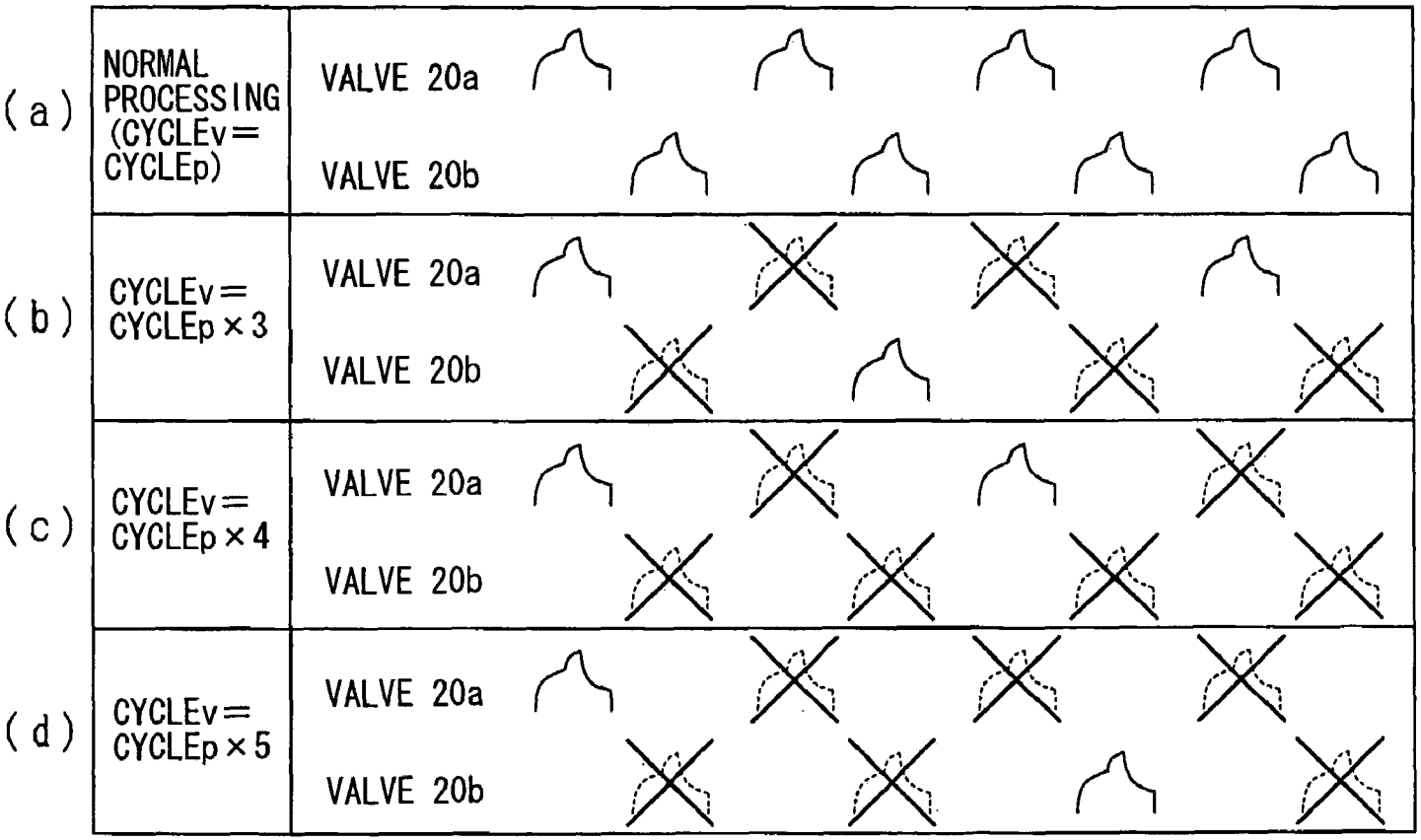
FIG. 5 is a time chart showing a mode of normal processing and a mode of reduction processing according to the first embodiment.

Part (a) of FIG. 5 shows an operation mode of the discharge metering valves 20*a*, 20*b* during a normal period. Part (b) to Part (d) of FIG. 5 show operation modes of the discharge metering valves 20*a*, 20*b* during the reduction processing. Part (b) of FIG. 5 shows an example in which the operation cycle of the discharge metering valves 20*a*, 20*b* is set three times as long as that of the normal period. Part (c) of FIG. 5 shows an example in which the operation cycle of the discharge metering valves 20*a*, 20*b* is set four times as long as that of the normal period. Part (d) of FIG. 5 shows an example in which the operation cycle of the discharge metering valves 20*a*, 20*b* is set five times as long as that of the normal period.

As shown in FIG. 5, the rotation angle interval between the time when the drive current is caused to flow through the discharge metering valves 20*a*, 20*b* and the time when the drive current is caused to flow through the metering valves 20*a*, 20*b* next time lengthens as the operation time number of the discharge metering valves 20*a*, 20*b* is decreased. Thus, the residual magnetic flux due to the previous drive current can be sufficiently reduced before the present operation.

There exists certain rotation speed (mechanical spontaneous closure limit speed), at which the force caused by the fuel in the pressurization chamber 50*a* (50*b*) exceeds the restoring force of the valve spring 24*a* (24*b*) although the electromagnetic solenoid 26*a* (26*b*) is not energized at all. The rotation speed causing the spontaneous closure can be increased by performing the above-described reduction processing. However, in this case, a margin of the rotation speed before the mechanical spontaneous closure limit speed is reached is reduced. Accordingly, there is a possibility that the rotation speed exceeds the mechanical spontaneous closure limit speed if the rotation speed unintentionally increases excessively during the reduction processing. In this case, there is a possibility that the discharge metering valve 20*a* (20*b*) closes even if the energization of the electromagnetic solenoid 26*a* (26*b*) is stopped and that the fuel is pressure-fed to the common rail 16 excessively.

Figure 6:
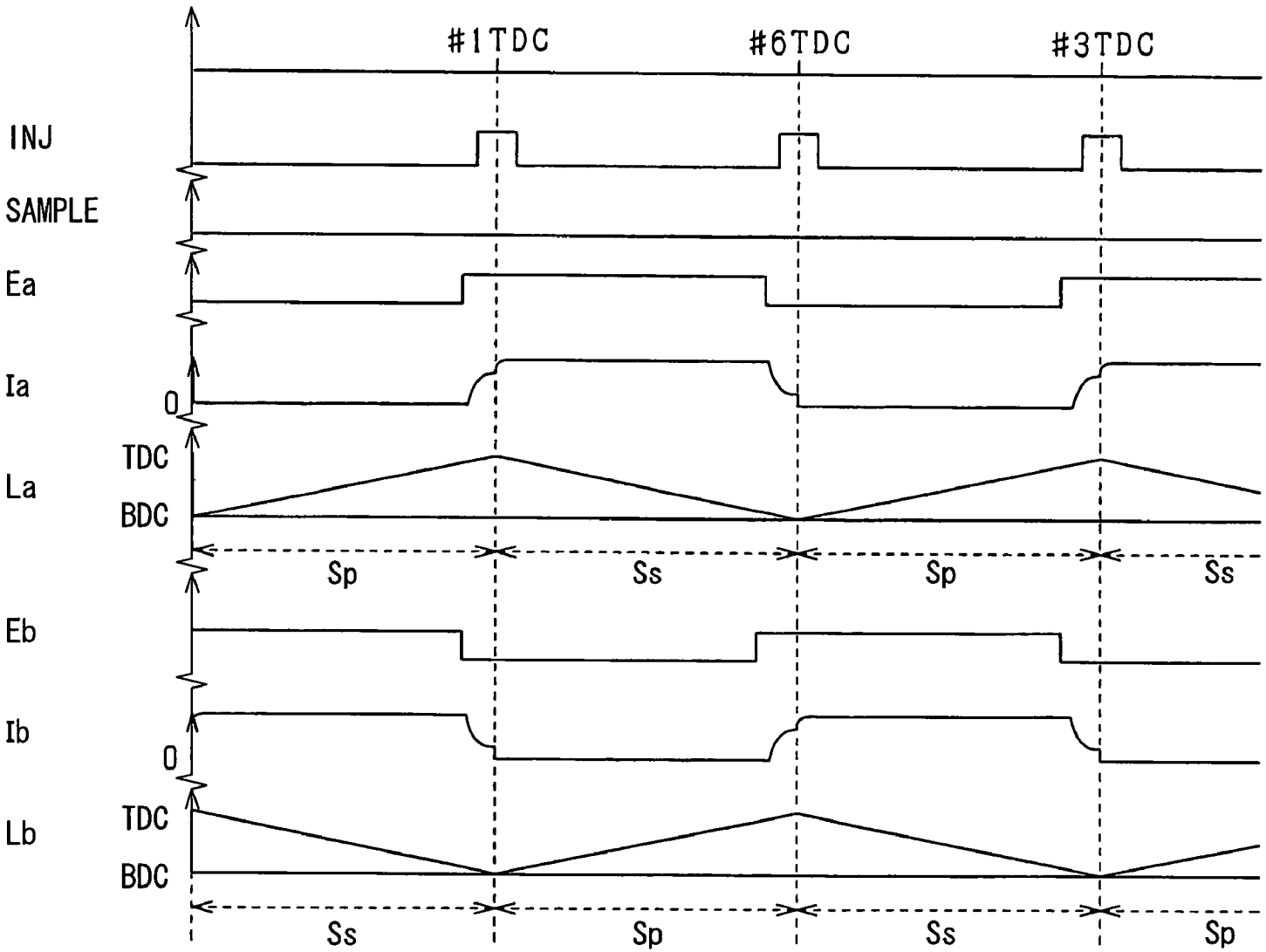
FIG. 6 is a time chart showing a mode of suction prohibition processing according to the first embodiment.

Therefore, the system according to the present embodiment energizes the electromagnetic solenoid 26*a* (26*b*) to close the discharge metering valve 20*a* (20*b*) during the suction stroke in which the plunger 48*a* (48*b*) moves from the top dead center toward the bottom dead center if the rotation speed NE of the output shaft 12 approaches to the mechanical spontaneous closure limit speed. Thus, the communication between the pressurization chamber 50*a* (50*b*) side and the low-pressure chamber 42*a* (42*b*) side is broken. Thus, there is little or no fuel in the pressurization chamber 50*a* (50*b*) when the plunger 48*a* (48*b*) moves from the bottom dead center toward the top dead center, so the fuel discharge from the fuel pump 14 can be prohibited. FIG. 6 shows a processing mode related to the prohibition of the fuel suction during the suction stroke.

As shown in FIG. 6, the energization command Ea (Eb) of the discharge metering valve 20*a* (20*b*) is outputted when the plunger 48*a* (48*b*) is positioned on a slightly advanced side of the top dead center (TDC), so the discharge metering valve 20*a* (20*b*) can be surely closed after the plunger 48*a* (48*b*) reaches the top dead center. The energization command Ea (Eb) is removed when the plunger 48*a* (48*b*) is positioned on a slightly advanced side of the bottom dead center (BDC). The removing timing of the energization command Ea (Eb) is set at timing capable of maintaining the discharge metering valve 20*a* (20*b*) at the closed state until the plunger 48*a* (48*b*) reaches the bottom dead center. As shown in FIG. 6, the removing timing of the energization command Ea (Eb) is set at as advanced a side as possible such that the energization of the electromagnetic solenoid 26*a* (26*b*) is surely stopped after the timing, after which the closure of the discharge metering valve 20*a* (20*b*) is unnecessary. Thus, the energization period of the electromagnetic solenoid 26*a* (26*b*) can be shortened. Accordingly, heat release from the electromagnetic solenoids 26*a*, 26*b* or from the ECU 30 energizing the electromagnetic solenoids 26*a*, 26*b* is reduced.

Figure 7:
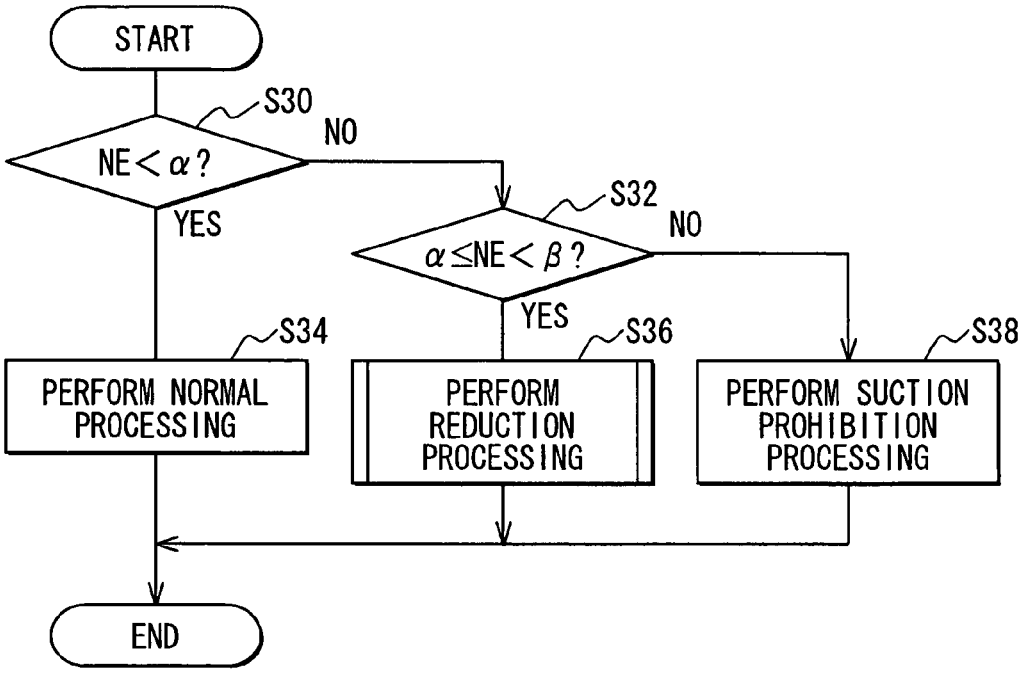
FIG. 7 is a flowchart showing processing steps of operation of the fuel pump according to the first embodiment.

FIG. 7 shows processing steps of the operation of the fuel pump 14 corresponding to the rotation speed of the output shaft 12. The ECU 30 repeatedly performs the processing shown in FIG. 7, for example, in a predetermined cycle. In a series of the processing, if the rotation speed NE is less than predetermined speed a (Step S30: YES), normal processing for conforming the cycle (CYCLEv) of the processing shown in FIG. 3 to the shortest cycle (plunger cycle CYCLEp), in which the fuel pump 14 can discharge the fuel, is performed (Step S34). The shortest cycle CYCLEp is a period of the rotation angle of the output shaft 12 from the time when either one of the plungers 48*a*, 48*b* reaches the top dead center to the time when the other one of the plungers 48*a*, 48*b* reaches the top dead center.

If the rotation speed NE of the output shaft 12 is equal to or higher than the speed a and is less than speed β (Step S32: YES), the reduction processing is performed (Step S36). The speed β is set at speed equal to or lower than the lowest rotation speed causing the spontaneous closure even when the reduction processing is performed. The reduction processing can be performed by setting the cycle CYCLEv of the processing shown in FIG. 3 at a cycle longer than the plunger cycle CYCLEp (i.e., CYCLEv>CYCLEp). If the rotation speed NE of the output shaft 12 is equal to or higher than the speed β (Step S36: NO), suction prohibition processing for prohibiting the suctioning of the fuel in the suction stroke is performed (Step S38).

Figure 8:
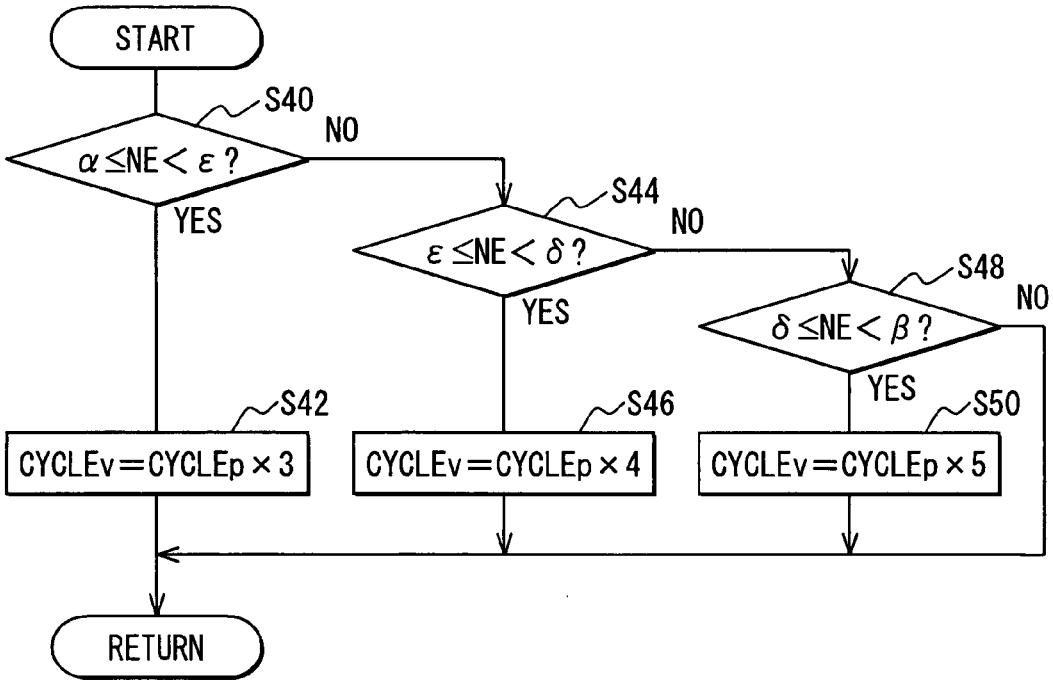
FIG. 8 is a flowchart showing processing steps of the reduction processing according to the first embodiment.

FIG. 8 shows the processing of Step S36 in detail. In a series of the processing, the cycle CYCLEv of the processing shown in FIG. 3 (control cycle) is set three times as long as the plunger cycle CYCLEp (i.e., CYCLEv=CYCLEp×3) (Step S42) if the rotation speed NE of the output shaft 12 is equal to or higher than the speed a and is lower than speed ϵ (Step S40: YES). Thus, the discharge metering valves 20*a*, 20*b* are operated in the mode shown in Part (b) of FIG. 5. If the rotation speed NE of the output shaft 12 is equal to or higher than the speed β and is lower than speed 6 (Step S44: YES), the cycle CYCLEv of the processing shown in FIG. 3 is set four times as long as the plunger cycle CYCLEp (i.e., CYCLEv=CYCLEp×4) (Step S46). Thus, the discharge metering valves 20*a*, 20*b* are operated in the mode shown in Part (c) of FIG. 5. If the rotation speed NE of the output shaft 12 is equal to or higher than the speed δ and is lower than the speed β (Step S48: YES), the cycle CYCLEv of the processing shown in FIG. 3 is set five times as long as the plunger cycle CYCLEp (i.e., CYCLEv=CYCLEp×5) (Step S50). Thus, the discharge metering valves 20*a*, 20*b* are operated in the mode shown in Part (d) of FIG. 5.

Figure 9:
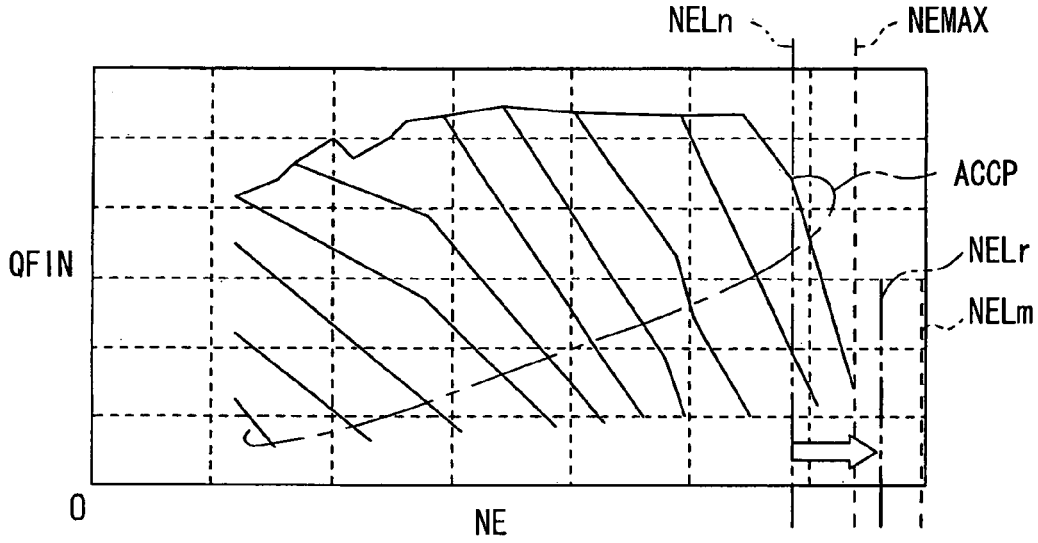
FIG. 9 is a diagram showing an improved mode of spontaneous closure rotation speed of a discharge metering valve according to the first embodiment.

FIG. 9 shows a situation of the rotation speed causing the spontaneous closure of the discharge metering valves 20*a*, 20*b* improved by the above-described processing. FIG. 9 shows the improved situation over a governor pattern, which decides the command injection amount QFIN used in the processing shown in FIG. 3 based on the rotation speed NE of the output shaft 12 and the operation amount ACCP of the accelerator pedal. As shown in FIG. 9, in the system according to the present embodiment, the spontaneous closure of the discharge metering valves 20*a*, 20*b* occurs at rotation speed NE (NELn) lower than the maximum rotation speed NEMAX of the governor pattern during the normal processing. NELn in FIG. 9 represents the lowest rotation speed causing the spontaneous closure during the normal processing (i.e., normal processing spontaneous closure limit speed NELn). By performing the reduction processing, the lowest rotation speed causing the spontaneous closure can be increased over the maximum rotation speed NEMAX. NELr in FIG. 9 represents the lowest rotation speed causing the spontaneous closure during the reduction processing (i.e., reduction processing spontaneous closure limit speed NELr). NELm in FIG. 9 represents the mechanical spontaneous closure limit speed. Thus, the fuel pressure-feeding operation of the fuel pump 14 can be appropriately performed to compensate the consumption of the fuel in the common rail 16 accompanying the fuel injection through the injectors 18. By setting the speed P used in the processing shown in FIG. 7 at the maximum rotation speed NEMAX or between the maximum rotation speed NEMAX and the mechanical spontaneous closure limit speed NELm, the suction prohibition processing can be performed when there is no need to compensate the consumption of the fuel in the common rail 16 caused by the fuel injection.

The present embodiment exerts following effects.

(1) The reduction processing for reducing the number of the operations of the discharge metering valves 20*a*, 20*b* is performed to lengthen the interval between the pressure-feeding operations with respect to the shortest cycle, in which the fuel pump 14 can discharge the fuel, if the rotation speed of the engine is equal to or higher than predetermined speed α. Thus, the rotation speed causing the spontaneous closure of the discharge metering valves 20*a*, 20*b* can be increased. Accordingly, the control of the fuel pressure can be performed more appropriately.

(2) The reduction processing is performed by lengthening the operation cycle of the discharge metering valves 20*a*, 20*b*.

Thus, the pressure-feeding of the fuel into the common rail 16 can be performed cyclically, stabilizing the fuel pressure.

(3) The calculation cycle of the feedback correction value is also lengthened when the operation cycle is lengthened. Thus, the calculation load for calculating the feedback correction value can be reduced. Moreover, excessive increase of the absolute value of the integral term due to the reduction processing can be averted.

(4) The degree of lengthening the time interval between the pressure-feeding operations is increased as the rotation speed of the engine increases. Thus, the increase of the residual magnetic flux at the present operation of the discharge metering valves 20*a*, 20*b* due to the previous operation can be suitably averted while minimizing the lengthening of the interval between the pressure-feeding operations.

(5) The suctioning of the fuel during the suction stroke through the operation of the discharge metering valves 20*a*, 20*b* is prohibited when the rotation speed of the output shaft 12 is equal to or higher than the speed β. Thus, the spontaneous closure of the discharge metering valves 20*a*, 20*b* caused by the suctioned fuel can be surely averted. Moreover, by energizing the discharge metering valves 20*a*, 20*b* only during the suction stroke, the heat generation in the discharge metering valves 20*a*, 20*b* or the ECU 30 operating the discharge metering valves 20*a*, 20*b* can be suitably inhibited compared to the case where the discharge metering valves 20*a*, 20*b* are constantly energized.

(6) When the plunger 48*a* (48*b*) moves from the bottom dead center to the top dead center due to the driving force of the engine, the discharge metering valve 20*a* (20*b*) moves due to the electromagnetic drive in the direction of the movement of the plunger 48*a* (48*b*). Thus, the communication between the fuel supply side and the plunger 48*a* (48*b*) side is broken and the fuel is discharged to the outside. In such the structure, there is a possibility that the fuel applies the force to the discharge metering valve 20*a* (20*b*) to induce the spontaneous closure of the discharge metering valve 20*a* (20*b*) when the plunger 48*a* (48*b*) moves to the top dead center. Accordingly, the above-described effects can be exerted suitably.

Figure 10A:
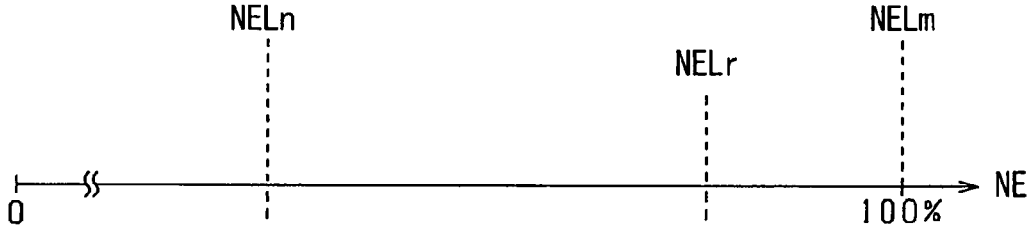
FIGS. 10A and 10B are diagrams showing a switching mode of various types of processing according to a second embodiment of the present invention.
Figure 10B:
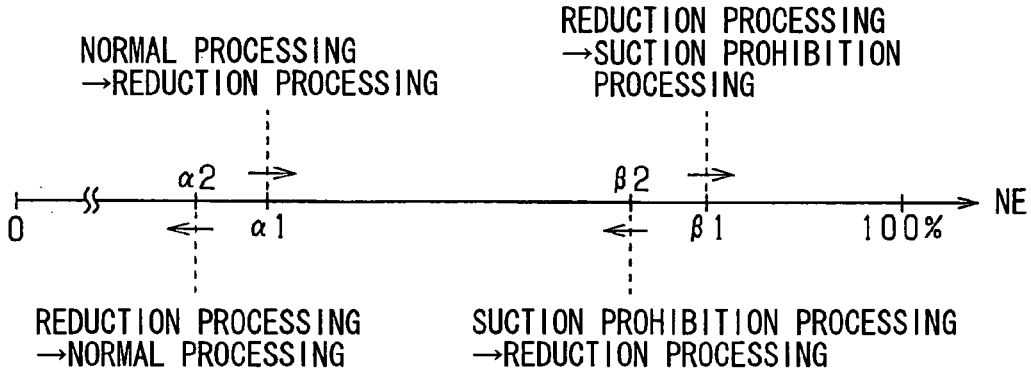

Next, a system according to a second embodiment of the present invention will be explained. FIGS. 10A and 10B show a switching mode among the normal processing, the reduction processing and the suction prohibiting processing according to the present embodiment. As shown in FIGS. 10A and 10B, in the present embodiment, a condition, under which the rotation speed NE of the output shaft 12 coincides with rotation speed α1, is used as a lengthening condition for switching from the normal processing to the reduction processing in accordance with the increase of the rotation speed NE of the output shaft 12. A condition, under which the rotation speed NE of the output shaft 12 coincides with rotation speed α2 lower than the rotation speed α1, is employed as a shortening condition for switching from the reduction processing to the normal processing in accordance with the decrease in the rotation speed NE of the output shaft 12. The rotation speed α1 is set at rotation speed equal to or lower than the lowest rotation speed (normal processing spontaneous closure limit speed NELn) causing the spontaneous closure during the normal processing. With such the setting, hysteresis can be set when the interval between the pressure-feeding operations is changed. Accordingly, frequent repetition of the changing of the interval between the pressure-feeding operations can be averted.

Moreover, in the present embodiment, a condition, under which the rotation speed NE of the output shaft 12 coincides with rotation speed β1, is used as a condition for switching from the reduction processing to the suction prohibition processing in accordance with the increase of the rotation speed NE of the output shaft 12. A condition, under which the rotation speed NE of the output shaft 12 coincides with rotation speed β2 lower than the rotation speed β1, is used as a condition for switching from the suction prohibition processing to the reduction processing in accordance with the decrease in the rotation speed NE of the output shaft 12. The rotation speed β1 is set at rotation speed equal to or lower than the lowest rotation speed (reduction processing spontaneous closure limit speed NELr) causing the spontaneous closure during the reduction processing. With such the setting, hysteresis can be set when the processing is changed. Accordingly, frequent repetition of the changing of the processing can be averted.

The present embodiment can exert following effects in addition to the effects (1) to (6) of the first embodiment.

(7) The lengthening condition and the shortening condition are set differently from each other. Thus, the hysteresis can be set when the interval between the pressure-feeding operations is changed. As a result, frequent repetition of the changing of the interval between the pressure-feeding operations can be averted.

(8) The condition for switching from the reduction processing to the suction prohibition procession and the condition for switching from the suction prohibition processing to the reduction processing are set differently from each other. Accordingly, the hysteresis can be set when the processing is changed between the reduction processing and the suction prohibition processing. As a result, frequent repetition of the changing of the processing can be averted.

Figure 11:
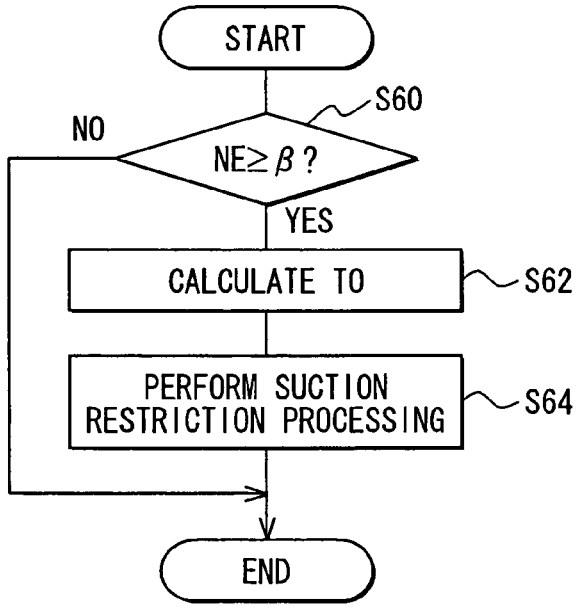
FIG. 11 is a flowchart showing processing steps of suction restriction according to a third embodiment of the present invention.

Next, a system according to a third embodiment of the present invention will be explained. The system according to the present embodiment performs processing for discharging the fuel from the fuel pump 14 also at rotation speed higher than the rotation speed causing the spontaneous closure during the reduction processing. FIG. 11 shows steps of the processing according to the present embodiment. The ECU 30 repeatedly performs the processing shown in FIG. 11, for example, in a predetermined cycle. In a series of the processing, first, Step S60 determines whether the rotation speed NE of the output shaft 12 is equal to or higher than the speed β. The speed β is et at a value for determining the timing for restricting the suctioning of the fuel into the pressurization chambers 50*a*, 50*b* of the fuel pump 14. The speed β is set equal to or lower than the lowest value of the rotation speed causing the spontaneous closure during the reduction processing.

If Step S60 is YES, Step S62 calculates the valve closure removing timing TO in the suction stroke based on the target fuel pressure PFIN and the sensed value NPC of the fuel pressure. The fuel in the low-pressure chambers 42*a*, 42*b* is suctioned into the pressurization chambers 50*a*, 50*b* after the valve closure is removed in the suction stroke. Accordingly, the fuel causes the spontaneous closure of the discharge metering valves 20*a*, 20*b* and the fuel can be discharged from the fuel pump 14. Therefore, by restricting the fuel suctioned into the pressurization chambers 50*a*, 50*b* to or under the required pressure-feeding amount required to conform the sensed value NPC of the fuel pressure to the target fuel pressure PFIN, the pressure-feeding operation can be continued while averting the excessive pressure-feeding of the fuel into the common rail 16.

After Step S62 calculates the valve closure removing timing TO, Step S64 performs suction restriction processing of the fuel pump 14. That is, the energization command is outputted to the discharge metering valve 20*a* (20*b*) at the timing slightly advanced from the top dead center of the plunger 48*a*

(48*b*). Thus, the discharge metering valve 20*a* (20*b*) is closed after the top dead center, and the energization is ended at the valve closure removing timing TO.

The processing shown in FIG. 11 is effective processing for a system that performs the fuel injection at rotation speed higher than the lowest value of the rotation speed causing the spontaneous closure during the reduction processing.

The present embodiment can exert following effects in addition to the effects (1) to (4) and (6) of the first embodiment.

(9) The fuel suction amount during the suction stroke is restricted to or under the required pressure-feeding amount required to conform the sensed value of the fuel pressure to the target fuel pressure when the rotation speed of the output shaft 12 is higher than the speed β. Thus, the pressure-feeding of the excessive fuel to the common rail 16 can be averted.

The above-described embodiments may be modified as follows.

In the third embodiment, the valve closure removing timing is not limited to the timing decided based on the sensed value of the fuel pressure and the target fuel pressure. For example, the timing may be decided further in consideration of the rotation speed, for example.

The lengthening mode of the operation cycle of the discharge metering valve 20 in the reduction processing is not limited to the mode shown in FIG. 5. For example, the operation cycle may be lengthened to be twice as long as the operation cycle of the normal processing period.

The condition for lengthening the interval between the pressure-feeding operations and the condition for shortening the interval between the pressure-feeding operations at the time when the processing is switched at Step S42, S46 or S50 may be set differently from each other. Thus, the frequent switching of the processing at Step S42, S46, or S50 can be averted.

The effects (1) to (3) of the first embodiment can be exerted even if the processing for increasing the lengthening degree of the rotation angle interval between the pressure-feeding operations as the rotation speed increases is not performed in the reduction processing.

The fuel pump 14 may not include the pair of discharge metering valves 20*a*, 20*b*. Alternatively, the fuel pump 14 may have a single discharge metering valve commonly used by the plungers 48*a*, 48*b*, for example. The number of the plunger(s) may be one, three or more.

The fuel injection system of the engine is not limited to the synchronous system but may be an asynchronous system. The internal combustion engine is not limited to the diesel engine but may be a direct injection gasoline engine, for example.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A fuel pressure controller applied to a fuel supply system having a fuel pump, which is driven by a driving force of an internal combustion engine to discharge and to pressure-feed fuel to a pressure accumulation chamber accumulating the pressure-fed fuel at a high-pressure state and which has an electromagnetic discharge metering valve for regulating a fuel amount discharged to an outside by the fuel pump out of fuel suctioned by the fuel pump, the fuel pump being capable of performing the fuel discharge in a certain shortest cycle, the fuel pressure controller comprising:

a control device that controls the fuel pressure in the pressure accumulation chamber by operating the discharge metering valve; and a reduction device that reduces the number of operations of the discharge metering valve to lengthen an interval between the pressure-feeding operations with respect to the shortest cycle when rotation speed of the engine is equal to or higher than predetermined speed, wherein the fuel pump has a plunger driven by the driving force of the engine to reciprocate between a top dead center and a bottom dead center; and the reduction device is configured to reduce the number of operations of the discharge metering valve by alternating between (a) providing a state in which the discharge metering valve is not operated even when the plunger mechanically enters a pressure-feeding stroke such that the fuel is not pressure-fed, and (b) providing a state in which the discharge metering valve is operated when the plunger mechanically enters the pressure-feeding stroke such that the fuel is pressure-fed.

2. A pressure control method of controlling fuel pressure in a pressure accumulation chamber accumulating fuel pressure-fed by a fuel pump, which is driven by a driving force of an internal combustion engine to discharge and to pressure-feed the fuel and which has an electromagnetic discharge metering valve for regulating a fuel amount discharged by the fuel pump out of fuel suctioned by the fuel pump, the fuel pump being capable of performing the fuel discharge in a certain shortest cycle, the pressure control method comprising:

controlling the fuel pressure in the pressure accumulation chamber by operating the discharge metering valve; and reducing the number of operations of the discharge metering valve to lengthen an interval between the pressure-feeding operations with respect to the shortest cycle when rotation speed of the engine is equal to or higher than predetermined speed, wherein the fuel pump has a plunger driven by the driving force of the internal combustion engine to reciprocate between a top dead center and a bottom dead center, and said reducing the number of operations of the discharge metering valve comprises alternately (a) providing a state in which the discharge metering valve is not operated even when the plunger mechanically enters a pressure-feeding stroke such that the fuel is not pressure-fed, and (b) providing a state in which the discharge metering valve is operated when the plunger mechanically enters the pressure-feeding stroke such that the fuel is pressure-fed.

* * * * *